US005377864A

United States Patent [19]

Blechl et al.

[11] Patent Number: 5,377,864

[45] Date of Patent: Jan. 3, 1995

[54] DRUG DISPENSING APPARATUS

[75] Inventors: Joseph Blechl, Ingleside; Panos Hadjimitsos, Buffalo Grove; James R. Kurtz, Mundelein, all of Ill.; Hiroyasu Shimizu; Manabu Haraguchi, both of Gunma, Japan

[73] Assignees: Baxter International Inc., Deerfield, Ill.; Sanyo Electric Co., Ltd., Osaha, Japan

[21] Appl. No.: 640,427

[22] PCT Filed: May 25, 1990

[86] PCT No.: PCT/JP90/00674

§ 371 Date: Mar. 23, 1992

§ 102(e) Date: Mar. 23, 1992

[87] PCT Pub. No.: WO90/14065

PCT Pub. Date: Nov. 29, 1990

[30] Foreign Application Priority Data

May 25, 1989 [JP] Japan ..... 1-132059
Apr. 23, 1990 [JP] Japan ..... 2-107295

[51] Int. Cl.[6] ..... G07F 11/18

[52] U.S. Cl. ..... 221/2; 221/13; 221/99; 221/102; 221/196; 221/197; 221/224; 221/256; 221/263; 221/312 C

[58] Field of Search ..... 221/2, 3, 12, 13, 99, 221/102, 133, 154, 191, 193, 195, 196, 197, 224, 256, 258, 263, 287, 289, 312 C, 266; 364/479

[56] References Cited

U.S. PATENT DOCUMENTS

| | | | |
|---|---|---|---|
| 2,606,803 | 8/1952 | Whelan | 221/13 X |
| 2,653,850 | 9/1953 | Vollten | 221/99 X |
| 3,437,238 | 4/1969 | Luba | 221/191 X |
| 4,225,056 | 9/1980 | Flubacker | 221/2 |
| 4,267,942 | 5/1981 | Wick, Jr. et al. . | |
| 4,360,125 | 11/1982 | Martindale et al. . | |
| 4,519,522 | 5/1985 | McElwee . | |
| 4,573,606 | 3/1986 | Lewis et al. | 221/3 X |
| 4,635,053 | 1/1987 | Banks et al. . | |
| 4,663,621 | 5/1987 | Field et al. . | |
| 4,785,969 | 11/1988 | McLaughlin | 221/2 |
| 4,814,592 | 3/1989 | Bradt et al. | 364/479 X |
| 4,847,764 | 7/1989 | Halvorson . | |
| 4,869,395 | 9/1989 | Rubbmark | 221/287 X |
| 4,967,928 | 11/1990 | Carter | 221/154 X |
| 4,995,498 | 2/1991 | Menke | 221/133 X |
| 5,190,185 | 3/1993 | Blechl | 221/154 X |

OTHER PUBLICATIONS

"A New Wave in Medical Distribution" from The Pulse dated Sep. 1989.

*Primary Examiner*—Robert P. Olszewski
*Assistant Examiner*—Dean A. Reichard
*Attorney, Agent, or Firm*—Kane, Dalsimer, Sullivan, Kurucz, Levy, Eisele and Richard

[57] ABSTRACT

The present invention provides for a drug dispensing device which is portable, provides a high level of security, is flexible in accommodating a number of user selected drugs, is easily stockable, and reduces labor and time requirement for drug dispensing. The present invention provides an apparatus having a microprocessor means which controls the drug dispensing. The apparatus includes an interior medication storage area adapted to receive a plurality of different sized dispensers in user selectable combinations. A receiving drawer is provided below the interior medication storage area to receive and dispense the medications.

A dispenser is provided which can be configured in a multiplicity of sizes and shapes to accommodate different sized medications. The dispenser is adapted to receive a cooperating cartridge which contains the medications. The dispenser includes an actuator which contacts and dispenses the medications from the cartridge.

20 Claims, 14 Drawing Sheets

DRUG DISPENSING APPARATUS

TECHNICAL FIELD

The present invention relates to automatic vending systems and, more particularly, to automatic controlled drug dispensing apparatus.

BACKGROUND ART

The delivery of controlled substances to patients in a hospital or other medical care environment has long been the subject of attempts at improvement. Initially, the controlled substances were shipped to medical facilities packaged in containers, such as bottles, jars, and the like. These containers were stored at a central pharmacy location. When a doctor required administration of a dose of a controlled substance to a patient, a prescription was written and a nurse was responsible for obtaining the dosage from the pharmacy and administering it to the patient.

In order to effectuate proper inventory control as well as improve security with regard to the controlled substance, the pharmacy was required to manually log the identity of the nurse receiving the medication, the type of medication dispensed, the amount of medication dispensed, the time of release of the medication, and other information necessary for proper inventory control. The nurse was also required to manually record the medication received, the amount of medication delivered, the patient to whom the medication was delivered, and the time the patient received the medication. Furthermore, if the controlled substance was subsequently delivered to the patient after the original nurse's shift was over, the additional nurse would be required to manually record the same type of information regarding her handling of the medication. Thus, it is seen that the administration of a controlled substance to a patient is both labor and time intensive as a commitment of a number of individuals as well as the time involved in manually recording the information regarding the distribution of the medication is required.

More recently, the containers of drugs have been remotely located within the medical facility at stations closer to the patients receiving the medication. In this system, while the pharmacy releases the containers of medicine to the various nurse substation, the inventory information is still required to be recorded. The containers of medicine are then stored behind locked cabinets at each nurse substation with the nurses retrieving the drug from the locked cabinet and administering the drugs to the patients. Of course, the nurses are still required to record the detailed information regarding the types of medication, the amount of medication, the time of administering medication, and other information regarding the administration of the medicine.

While this system of administration more quickly brings the controlled substance to the patient, it suffers from the same drawbacks of the previous system of being labor and time intensive as well as the additional drawback of reducing the security of the controlled substances while they are at the remote locations.

In an effort to improve these systems, various devices have been designed for distributing unit dose medication from an apparatus. While these various apparatus are an improvement over the manual systems previously discussed, such systems are exceedingly large, therefore requiring use in a centralized dedicated location, require use of pharmacy resources and time to properly load and inventory machines, and are dedicated to specific forms of drug to be dispensed. What is thus needed, is a relatively portable drug dispensing apparatus which provides a high level of security for the drugs being dispensed, is sufficiently flexible to all distribution of drugs of varying dosage formats, is easily reloaded with new drug, and reduces the labor and time drawbacks of the prior art. The present invention fulfills these requirements.

DISCLOSURE OF INVENTION

The present invention provides for a drug dispensing device which is portable, provides a high level of security, is flexible in accommodating a number of user selected drugs, is easily stockable, and reduces labor and time requirements for drug dispensing. The present invention provides an apparatus having a microprocessing means which controls the drug dispensing. The apparatus includes an interior medication storage area adapted to receive a plurality of different sized dispensers in user selectable combinations. A receiving drawer is provided below the interior medication storage area to receive and dispense the medications.

A dispenser is provided which can be configured in a multiplicity of sizes and shapes to accommodate different sized medications. The dispenser is adapted to receive a cooperating cartridge which contains the medications. The dispenser includes an actuator which contacts and dispenses the medications from the cartridge.

BEST MODE FOR CARRYING OUT THE INVENTION

Figure 1:
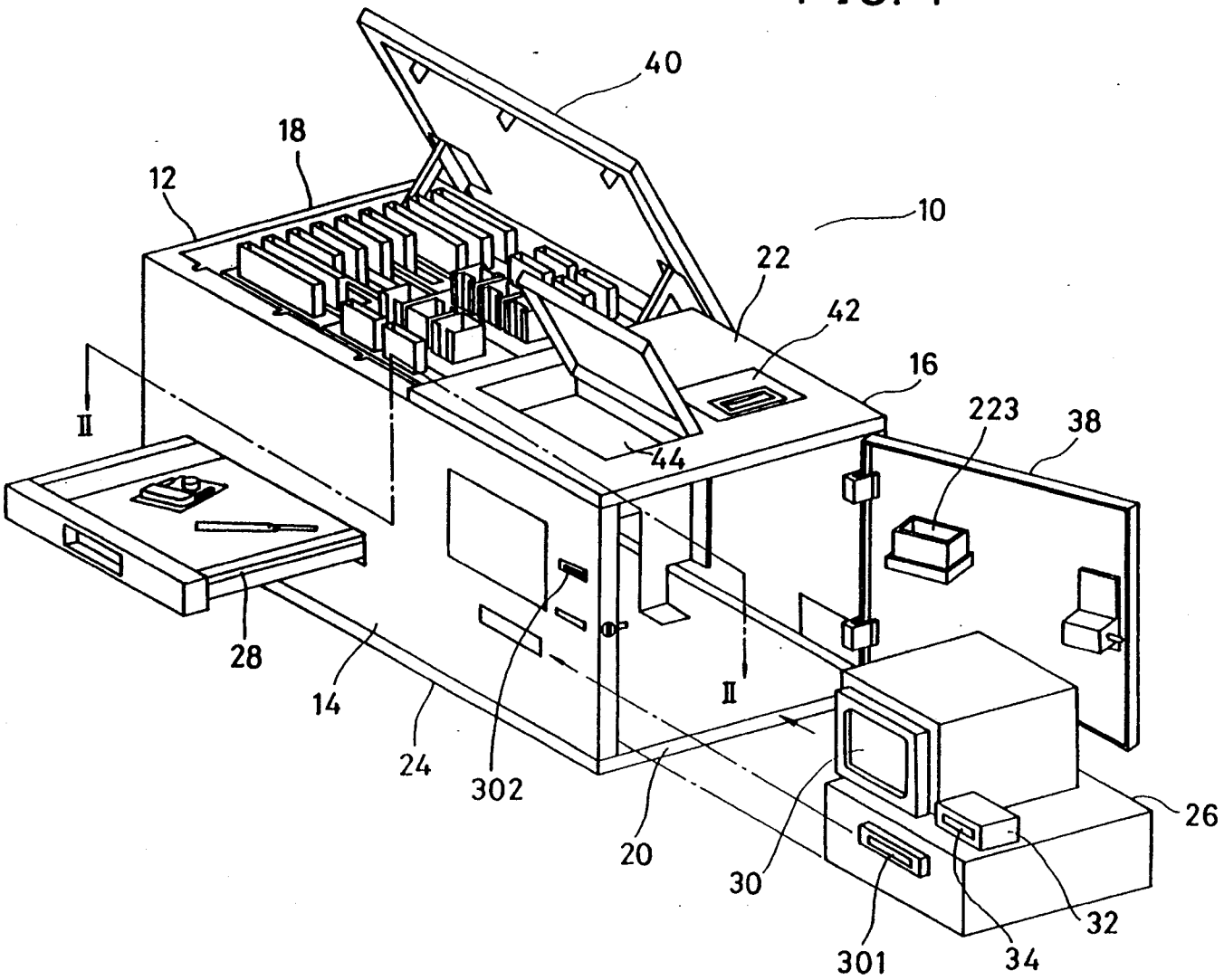
FIG. 1 is a perspective view of a device made in accordance with the principles of the present invention.
Figure 10:
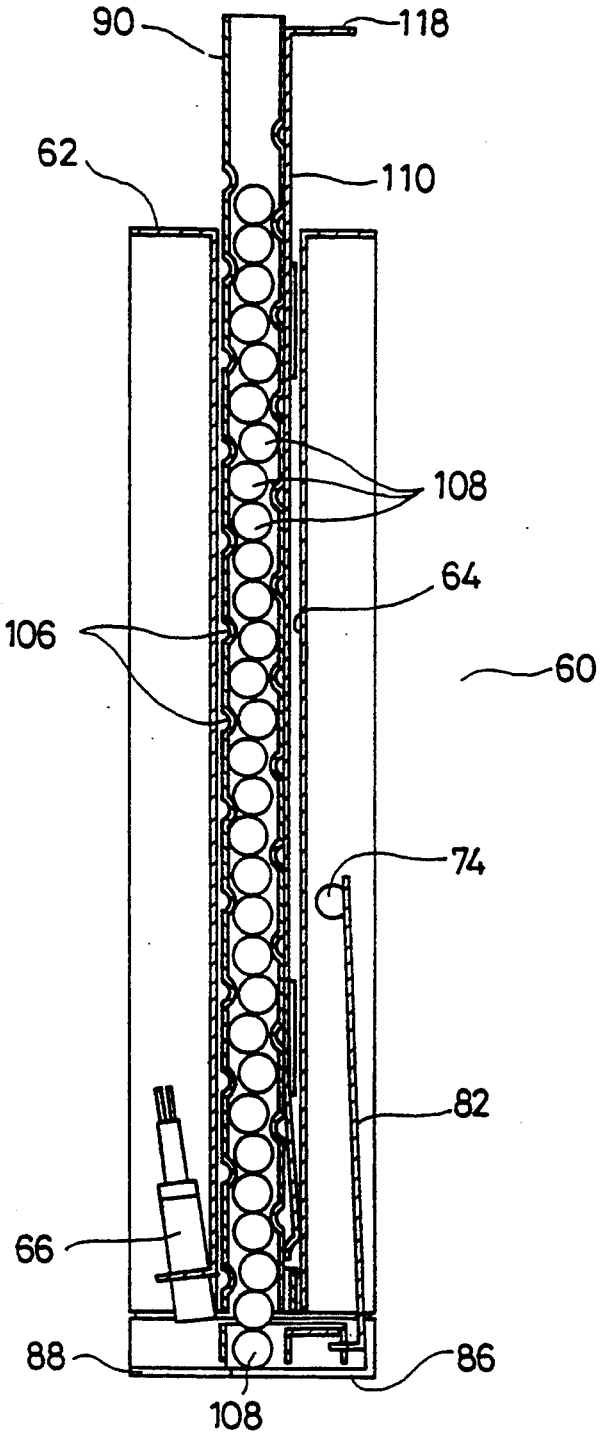
FIG. 10 is a cross sectional cut-away view similar to FIG. 4 showing the cartridge of FIGS. 5, 6 and 7 in the dispenser of FIGS. 3 and 4.

Referring to FIG. 1, a drug dispensing device made in accordance with the principles of the present invention is designated generally by FIG. 10. The drug dispensing device 10 includes housing 12 employing a generally rectangular box shape. The drug dispensing device 10 includes a front 14 and a rear 16, two sides 18, 20, and a top 22 and bottom 24. The drug dispensing device 10 is contained in a small area with the presently preferred embodiment being approximately 30 inches (76.2 cm) wide, 20 inches (50.8 cm) tall and 20 inches (50.8 cm) deep. Thus, the presently preferred device 10 can readily be placed on a countertop at remote substations. Additionally, the device 10 can also be placed on a dedicated stand or wall mounted if counter space is not available. It will be seen that all of the advantageous features described herein can be contained in a device 10 employing these dimensions.

Figure 13:
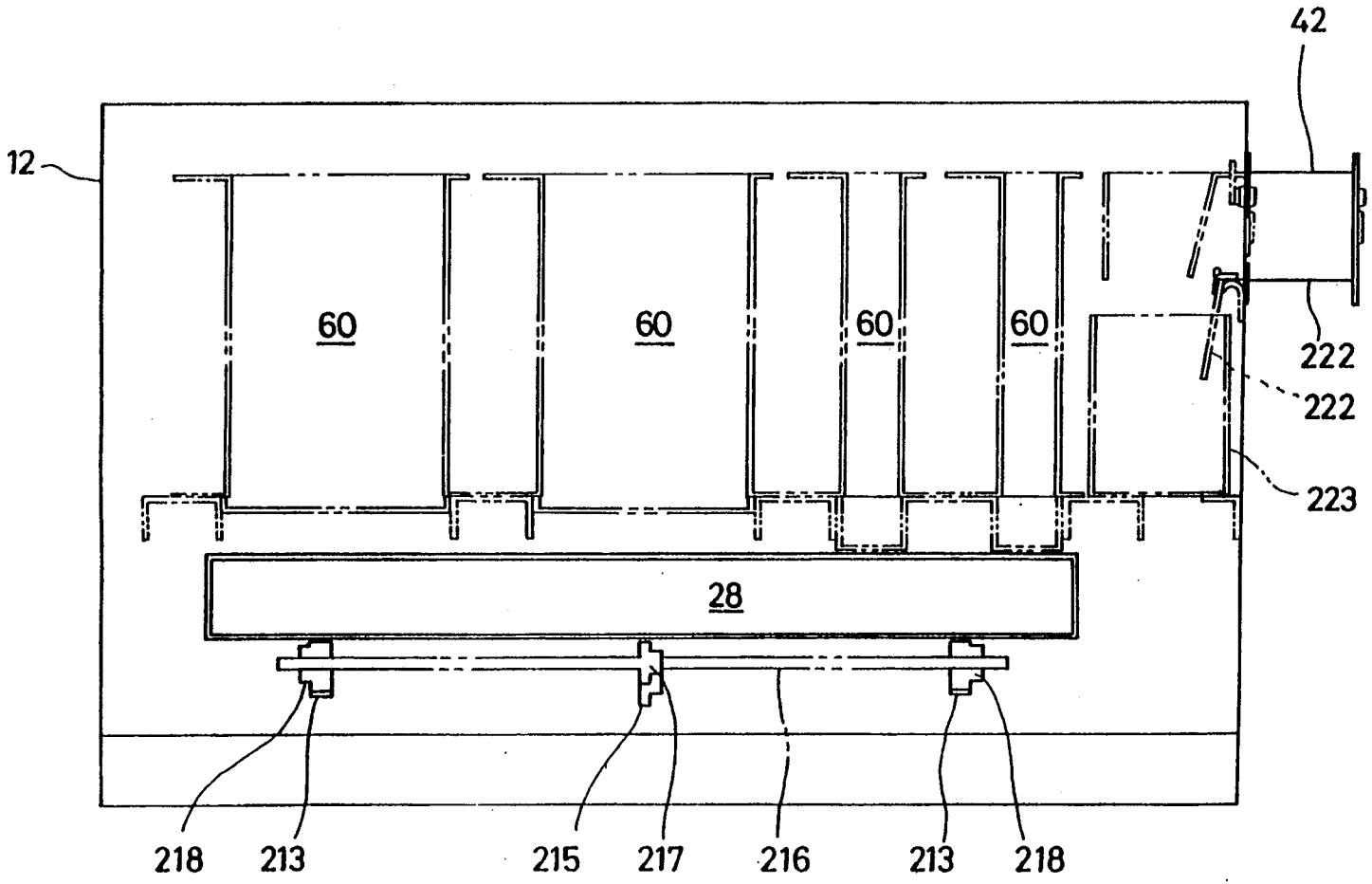
FIG. 13 is a front view of the apparatus of FIG. 1.
Figure 14:
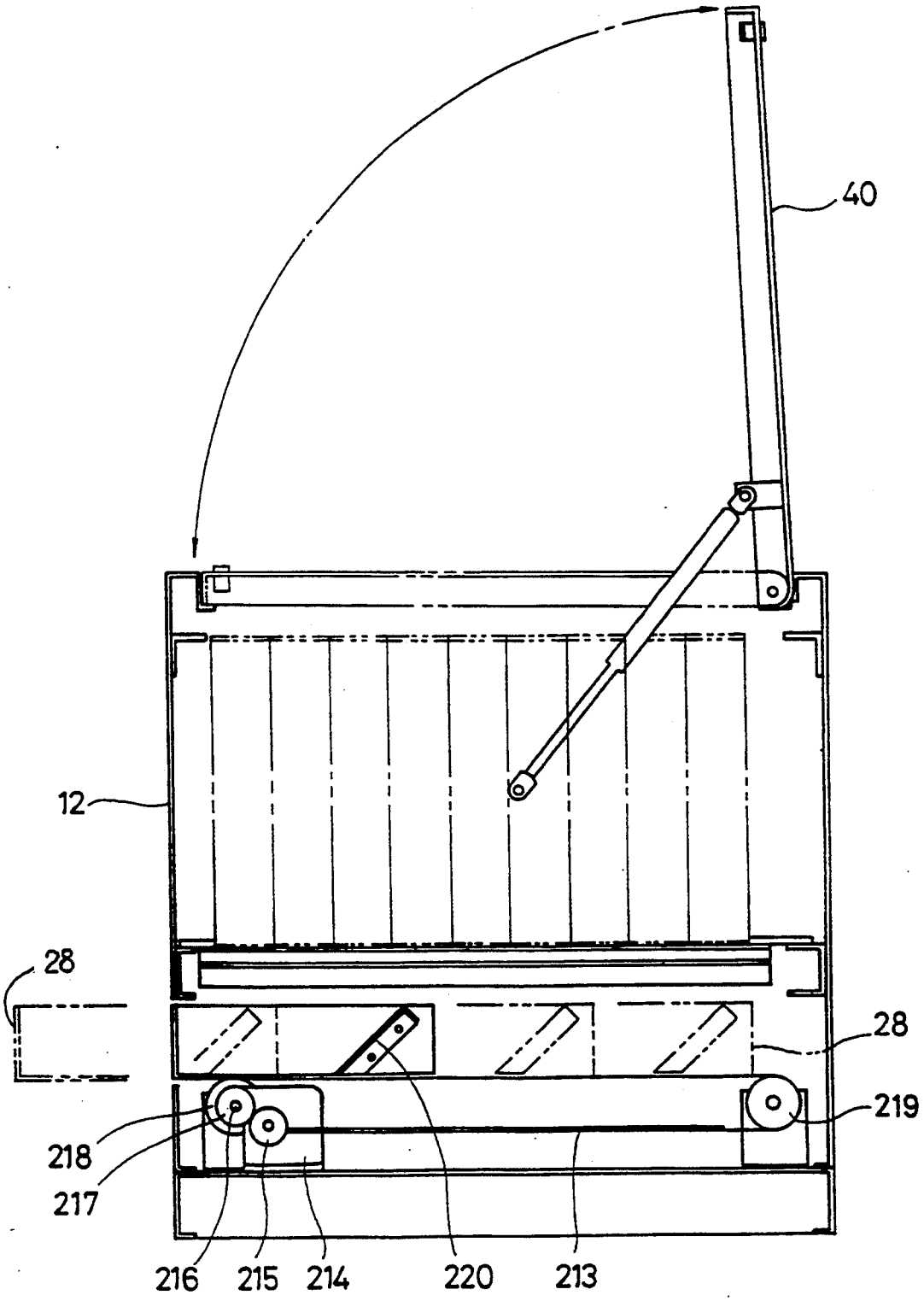
FIG. 14 is a side view of the apparatus of FIG. 1.

The front 14 of the device 10 contains a locked dispensing drawer 29 which provides access to the dispensed medicines. When access is allowed, as explained in detail below, a locking latch mechanism releases and the drawer 28 can be pulled into the open position. The drawer 28 can be controlled manually or automatically in the movement. An example of the automatic control is shown in FIGS. 13 and 14. As shown in the Figures, the drawer 28 is fixed above the two belts 213 and automatically slides a designated amount in and out of the device 10. The drive unit for the drawer 28 is comprised of the motor 214 which operates as a result of signals issued from the microprocessing means 26 described later, the roller 215 which rotates on the motor shaft, the pressure roller 217 which is pressed by shaft 216 against the roller 215, two drive rollers 218 which are fixed to the two ends of the aforementioned shaft 216 and which revolve together with the pressure roller 217, two idling rollers 219 installed opposite to the two drive rollers 218, and the two belts 213 which are stretched between the two drive rollers 218 and the two idling rollers 219. The drawer 28 can move together with the two belts 213 on which it is fixed. The drawer 28 is formed in the dimension which corresponds to two files of the dispenser 60 described later in width and three ranks of the dispenser 60 in depth, i.e. in the dimension less than a half of the plane area of the device 10.

When the user designates a type and quantity of desired medications into the later-described input unit 248 of the control device 300, the said medications drop from their cartridges 90 into the drawer 28 as follows: Based on the information provided to the input unit 248 of the control device 300, the drawer 28 automatically moves forward or back the distance required to locate it underneath the dispenser 60 containing the designated medications. In this way, the drawer 28 can be constructed compactly while still servicing all of the dispenser 60, reducing the amount of space required for the drawer 28 to protrude from the device 10 and serving to reduce the overall space required for the device. Further, a slanted guide plate 220 is fitted to the rear of the drawer 28 in order to cause medications dropped from the cartridges 90 to be located toward the front of the drawer 28, thus facilitating removal of the medications from the drawer 28.

A user interface screen 30 which is in communication with microprocessing means 26 (shown in phantom in FIG. 2) and which employs touch sensitive features known in the art is further provided as the input unit 248 on the front 14 of the device 10 to allow the user to communicate with the microprocessing means 26. The microprocessing means 26 can preferably be a type XT, AT or PS/2 Personal Computer manufactured by IBM Corporation, Boca Raton, Fla. 33429. A card reader 32 known in the art is further provided having a slot 34 into which a magnetic user the identification card is inserted or "swiped" to gain access to the microprocessing means 26 programs. A suitable card reader 32 can preferably be a MP2A manufactured by Tokyo Tatsuo Corporation, Tokyo, Japan.

Floppy disc unit 301 which memorizes the driving system of the device is further provided.

Thus, to initiate use of the device 10, a designated individual having access is assigned a magnetic, optical or integrated circuit identification card and a personal identification number (PIN). When the user desires to dispense medication, for example, the user initiates dispensing by inserting an identification card into the card reader 32, upon which the microprocessing means 26 of the present device 10 requests the user to input a personal identification number (PIN). The user's personal identification number (PIN) is then inserted into the microprocessing means 26 via the user interfaced touch screen 30 and, if the personal identification number (PIN) and the identification card are a match, the dispensing can proceed as will be described in more detail below. Alternatively, a finger print or retina scan device can be utilized particularly when extremely sensitive drugs are stored in the device 10.

The front of the device 10 further contains a rejection port 302 for output of a print.

One side 20 of the device 10 is provided as a door 38 which is hingedly secured to the housing 12 and includes a locking latch mechanism to secure the door 38 in the closed position. Thus, an individual such as a pharmacist or mechanic who is allowed access to the interior of the device 10 is identified through an identification card and personal identification number (PIN), the door 38 can be opened through user interface with the touch screen 30 and microprocessing means 26 to gain access to the interior of the device 10 for servicing or return drug removal.

The top 22 of the device 10 is provided with a medication access door 40. The medication access door 40 is hingedly secured to the housing and includes a locking latch mechanism to control access. Once again, when a user such as a pharmacist designated to stock and configure the device 10 is identified through an identification card and personal identification number (PIN), the locking mechanism releases and access to the interior of the device 10 can be gained.

The top 22 further includes a first auxiliary door 42 which allows access to an interior storage compartment when the user desires to return medication. The first auxiliary door 42 is secured by a locked latch mechanism. The first auxiliary door 42 can be opened in response to a request by a user to returned unused drug. When the user has logged the drug being returned from the input unit 248, the locked latch mechanism releases the first auxiliary door 42, which can then be opened, the drug is inserted, and the user then closes the first auxiliary door 42 into a secured latched engagement. Because of the storage of returned drugs, the first auxiliary door 42 can preferredly include a secured double walled configuration such as a trap door leading to a second service storage area which prevents subsequent access to the previously returned drugs. An example of the construction of the first auxiliary door 42 is shown in FIG. 13, the first auxiliary door 42 has a fall-away lower floor plate 222 which is hinged at its front edge. When the door is in the extended (open) position, the floor plate serves as normal bottom to the door, but when the door is in the retracted (closed) position, the floor plate 222 drops downward at hinge as shown at the two-dot chain line in FIG. 13, thus operating as a vertical trap door. A receptacle 223 is provided beneath the first auxiliary door 42.

Further provided on the top 22 of the device 10 is a second auxiliary door 44 which allows access to a universal compartment of size and configuration sufficient to allow storage of oddly sized medications which do not fit into a dispenser 60 and cartridge 90 of the present device 10. Once again, the second auxiliary door 44 is secured by a locked latch mechanism and access to the universal compartment is achieved by a user requesting dispensing of a medication previously identified the microprocessing means 26 as found in the universal compartment.

Figure 2:
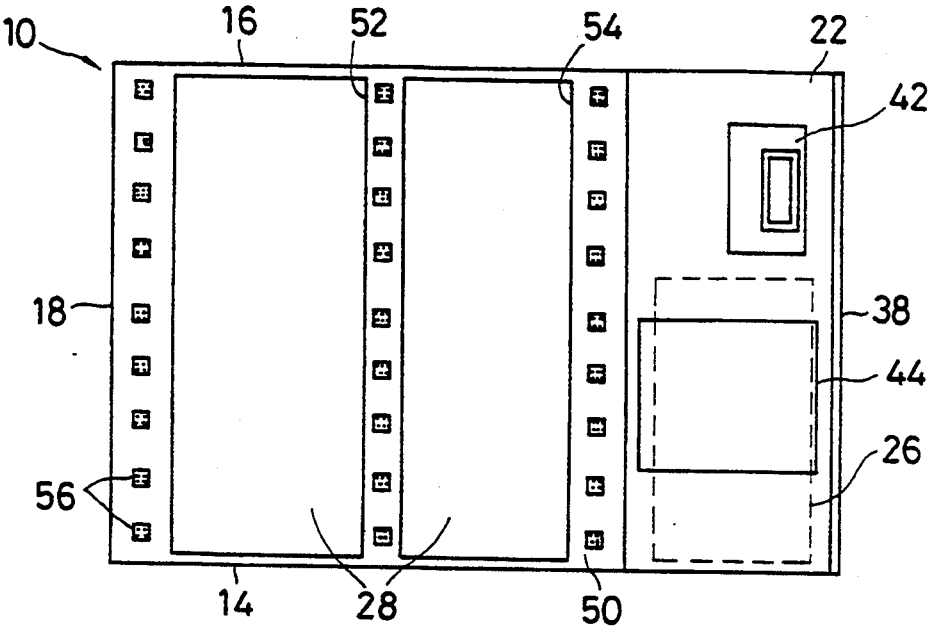
FIG. 2 is a partially cut-away overhead view of the device of FIG. 1 taken along the line II—II in FIG. 1.

Referring now to FIG. 2, a cut-away top view of the device 10 is seen showing the medication storage area. In this view, the medication storage area contains neither dispensers 60 nor cartridges 90 needed to actuate dispensing of the medications.

A printed circuit board 50 is provided which defines two apertures 52, 54 sized to allow free fall to the secured dispensing drawer 28. The dispensing drawing 28 is provided with padding on the interior surface to gently break the free fall of drug containers.

Further provided in the printed circuit board 50 are a plurality of female electrical connectors 56 which can be an 8 circuit type located at standard intervals on the circuit board 50 about the perimeter of the defined apertures 52, 54. The female electrical connectors 56 are electronically connected with the microprocessing means 26 as well as an electrical power source (not shown) to provide both electrical power to the device 10 as well as electrical communication with the microprocessing means 26.

Additionally, while the female electrical connectors 56 are standard spaced to accommodate the smallest sized dispensers 60, a plurality of differently sized dispensers 60 are provided adapted to be mated with the female electrical connectors 56, as will be described in detail below. Thus, a user can select from a variety of sized dispensers 60 to dispense medication in accordance with the specific needs of the users of the device 10.

Figure 3:
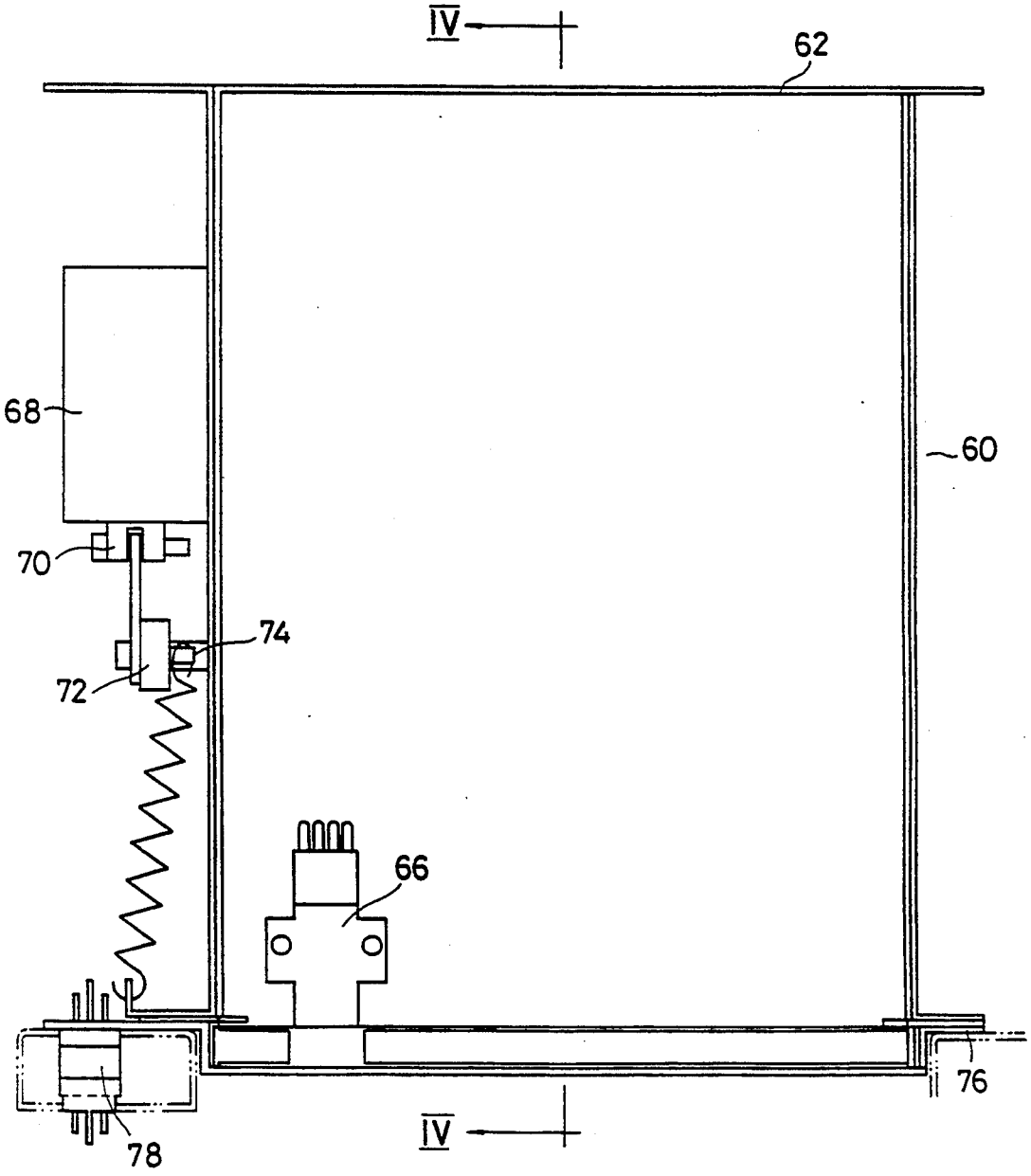
FIG. 3 is an elevational front view of a dispenser made in accordance with the principles of the present invention.
Figure 4:
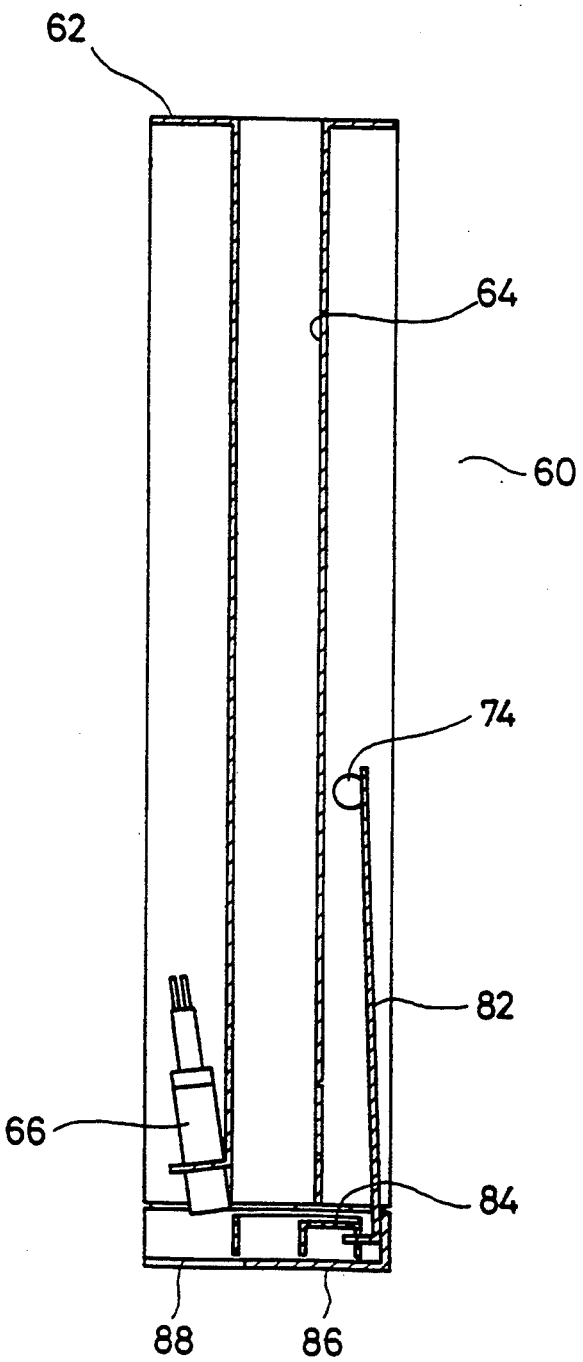
FIG. 4 is a cut-away view taken along the line IV—IV of FIG. 3.

Referring now to FIGS. 3 and 4, a preferred embodiment of the dispenser 60 made to be inserted into the medication storage area is seen. The dispenser 60 includes dispenser housing 62 defining an interior space 64 sized to receive a cartridge 90 as will be described in detail below. An optical sensor 66 is provided on the dispenser housing 62 to monitor the dispensing of the medication.

A solenoid 68 (which may be substituted by a motor) is provided on the exterior of the dispenser housing 62. Solenoid 68 includes a reciprocating piston 70 which is operatively connected to rotating linkage 72 which is contained on a pivot rod 74. The pivot rod 74 is rotatably journaled in the dispenser housing 62. Upon actuation, the solenoid piston 70 is retracted by the solenoid 68 whereupon the rotating linkage 72 causes rotation of pivot rod 74.

Contained offset from the bottom of the dispenser 60 is a surrounding support lip 76 which rests against the printed circuit board 50 to support the dispenser 60. Contained on the support lip 76 and extending downward from the support lip 76 is a male electrical connector 78 which can be 8-pin quick connect type which can be cooperatively connected to the female electrical connector contained in the printed circuit board 50. The male electrical connector 78 is electronically connected with the solenoid 68 and the optical sensor 66. Thus, as previously seen, when an electrical connection is made, power is supplied to the solenoid 68 and the optical sensor 66 and electronic communication is established between the solenoid 68, optical sensor 66 and the microprocessing means 26.

Referring now to FIG. 4, an elevated cut-away view of the dispenser 60 is seen. Pivot rod 74 is secured to a generally L-shaped, stepped actuator arm 82. The generally L-shaped, stepped actuator arm 82 extends downwardly from the pivot rod 74 with a stepped portion 84 being contained near the bottom of the dispenser 60.

Figure 18:
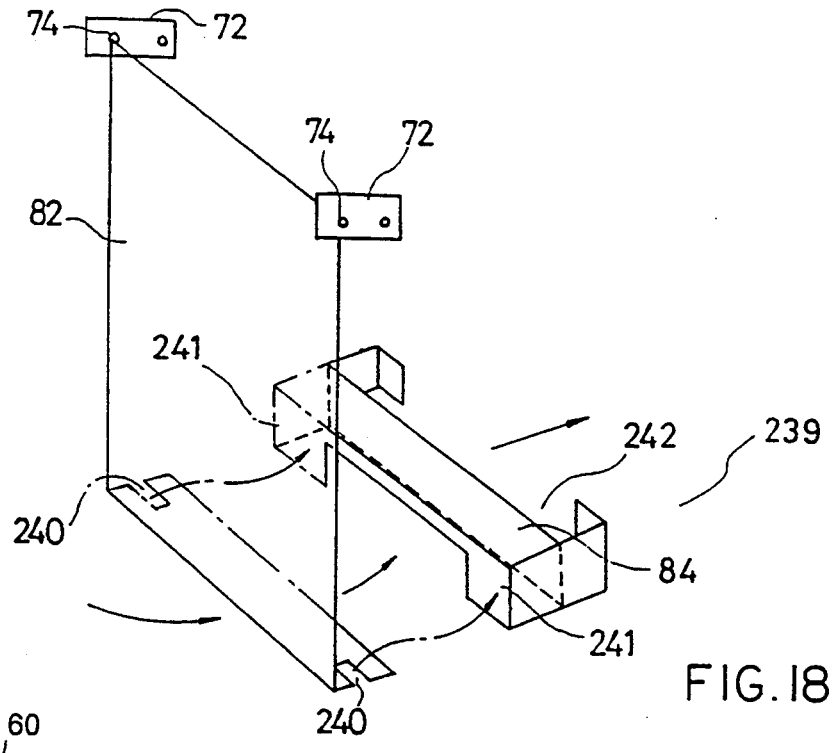
FIG. 18 is a partially cut-away perspective view of an actuator.

Concretely, as shown in FIG. 18, the stopper 241 of an ejector 239 is engaged to the cutaway 240 in the stepped portion 84, the ejector 239 which has a portion 242 retaining medication containers 108 is secured to the actuator arm 82.

The bottom of the dispenser 60 includes a dispensing platform 86 juxtaposed relative to the interior space 64. The receiving platform 86 defines an aperture 88 which extends across the entire width of the dispenser 60 and is offset from the longitudinal axis of the interior space 64. The optical sensor 66 is provides located juxtaposed over the defined aperture 88.

Figure 5:
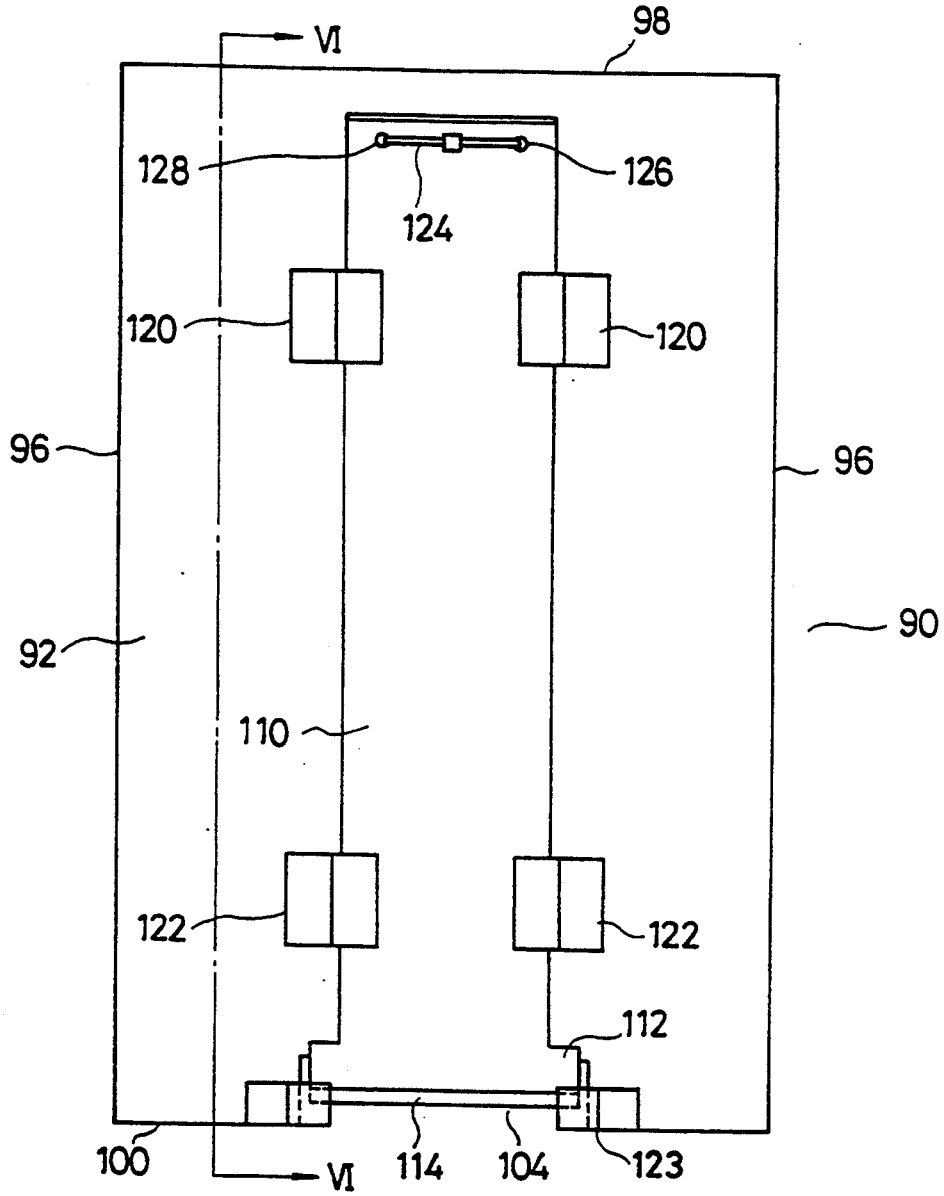
FIG. 5 is an elevational front view of a cartridge made in accordance with the principles of the present invention.
Figure 7:
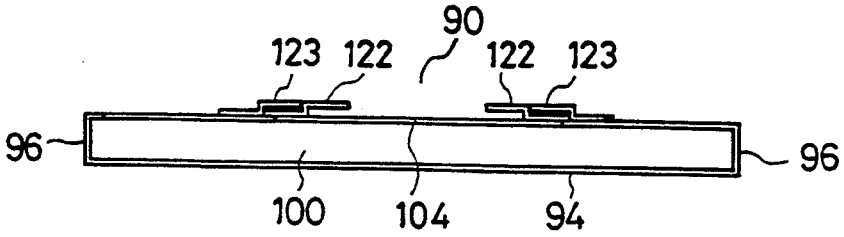
FIG. 7 is a bottom view of the cartridge of FIG. 5.
Figure 6:
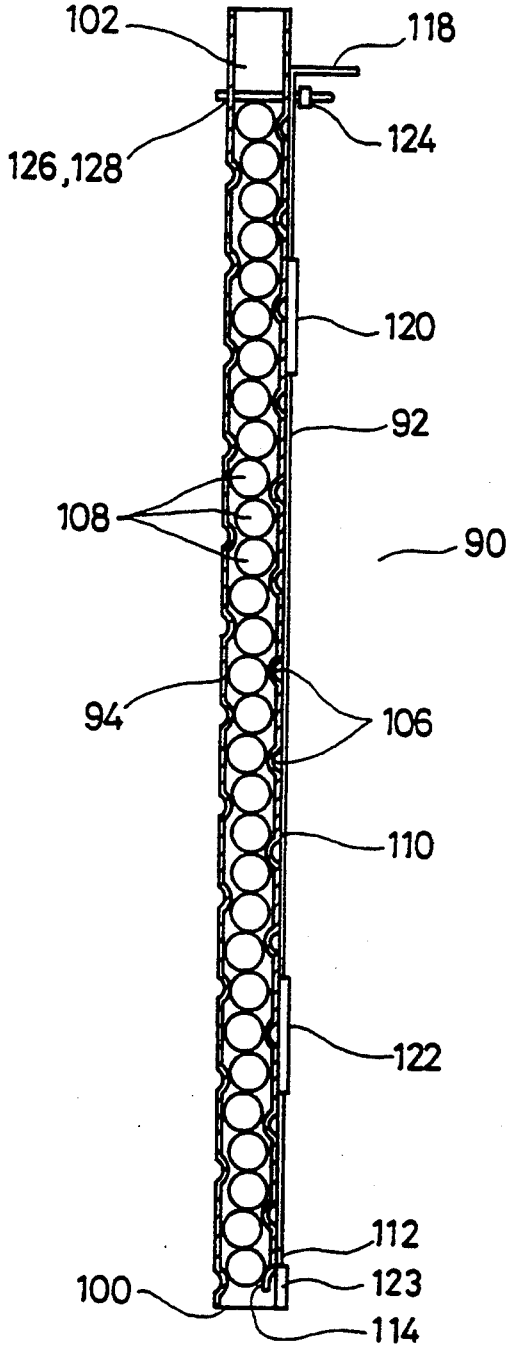
FIG. 6 is a cut-away, elevational side view of the cartridge of FIG. 5 taken along the line VI—VI in FIG. 5.

Referring now to FIGS. 5, 6 and 7, a preferred embodiment of the cartridge 90 to be inserted into the dispenser 60 is seen. The cartridge 90 is sized to cooperatively slide into the interior space 64 of the dispenser 60. The cartridge 90 includes front 92, back 94 and side walls 96, as well as a top 98. On the front 92 of the cartridge 90 extending upwardly from the open bottom 100, a rectangular cut-out 104 is defined.

Thus, the cartridge 90 defines an enclosed interior storage area 102 having an open bottom 100. Defined on the interior surface of the front 92 and back 94 wall are a plurality of inwardly projecting ribs 106. The inwardly projecting ribs 106 are oriented on a horizontal arrangement to help orient the falling medication containers which are stored and dispensed from the cartridges explained in detail below.

Figure 17:
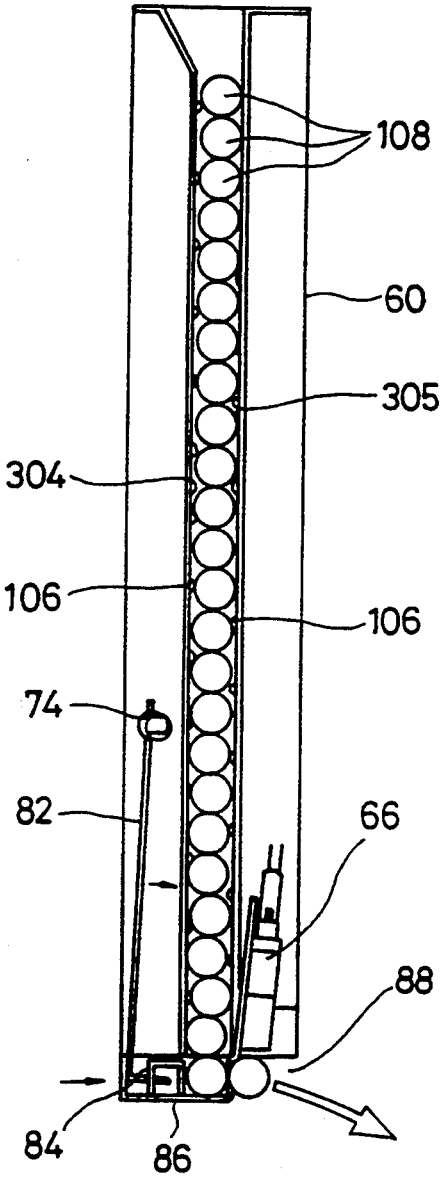
Figure 16:
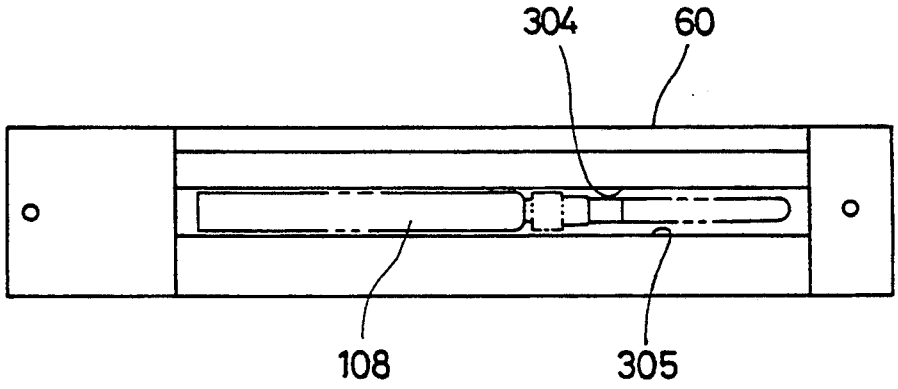

In another embodiment, a dispenser and a cartridge may be formed in one body. For example, as shown in FIG. 17, the dispenser 60 itself serves for a cartridge. In this case, ribs 106 is provided with the two side 304, 305 of the dispenser 60.

Contained in the interior storage space 102 are a plurality of stacked medication containers 108. While the embodiment depicted in FIGS. 5, 6 and 7 contain syringes or vials, it will be appreciated that various medication containers such as for example, oral solids, ampules, liquid cups, and the like, can readily be contained in dedicated cartridges 90 by altering the proportions of the cartridge 90 and dispenser 60.

In transportation, storage and loading, the medication containers 108 are prevented from falling out the open bottom 100 by means of a retaining member 110. The retaining member 110 defines an upper and lower periphery and is generally an inverted T-shape with an expanded width area 112 found at the lower periphery. The expanded width area 112 corresponds in size to the rectangular cut-out 104 defined on the front 92 of the cartridge 90.

Figure 8:
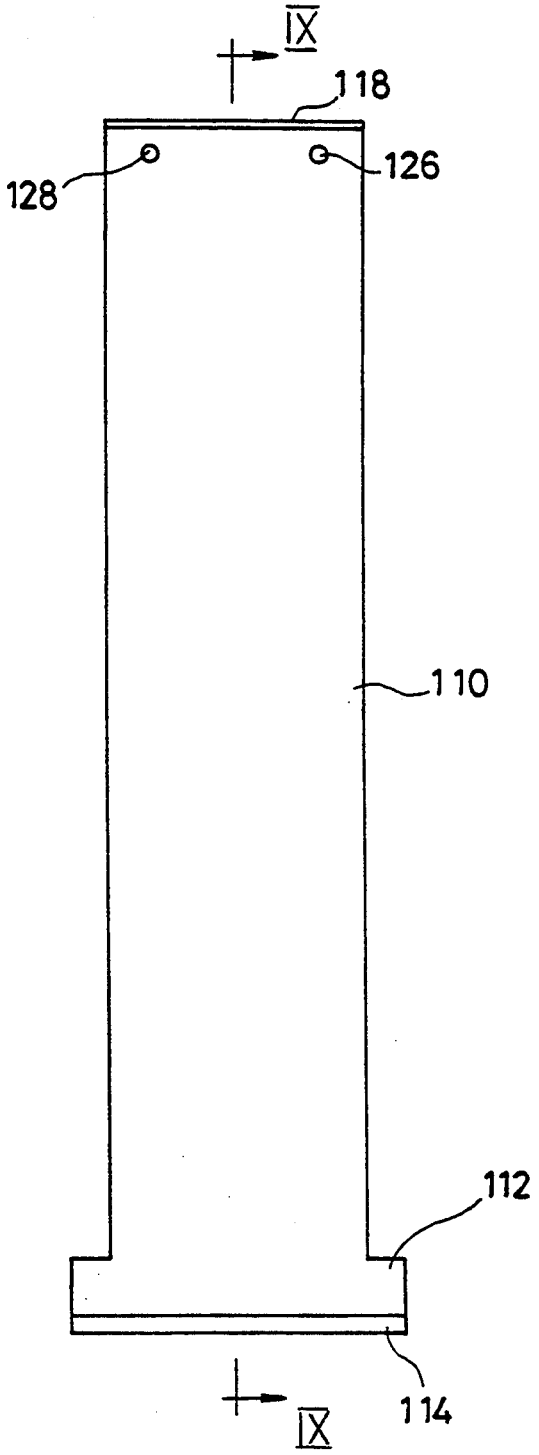
FIG. 8 is a detailed side elevational view of the retainer of FIG. 5.
Figure 9:
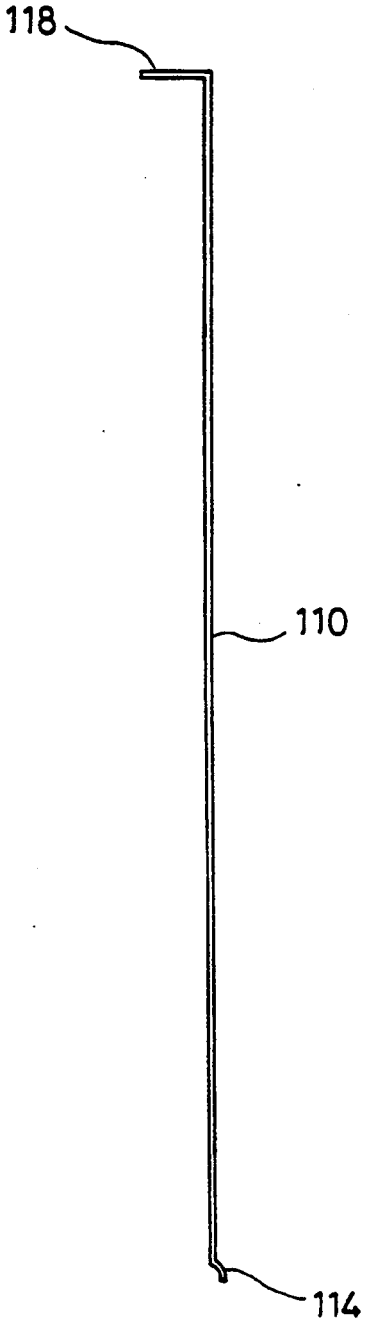
FIG. 9 is a cut-away side view of the retainer of FIG. 8 taken along the line IX—IX of FIG. 8.

Referring to FIGS. 8 and 9, the retaining member 110 is seen in detail. The expanded width area 112 includes at its lower periphery an L-shaped portion 114 which extends into the rectangular cut-out 104. Thus, the medication containers 108 abut against the L-shaped portion 114 which acts to contain the medication containers 108 within the interior storage area 102.

The upper periphery of the retaining member 110 includes an outwardly extending flange 118 to enable the user to grip and pull the retaining member 110. The retaining member 110 is secured to the front 92 of the cartridge 90 by adhesives 120, 122, 123 securing the retaining member 110 near its upper and lower periphery.

A wire 124 is further provided extending through the adhesive 120 located near the upper periphery of the retaining member 110 and through a pair of apertures 126,128 defined in both the front 92 and back 94 of the cartridge 90. Retaining member 110 is utilized to indicate tampering. Thus, prior to loading the medication containers 108 into the dispenser 60, the user must disengage the wire 124 thus providing evidence of use. In addition, as best seen in FIG. 6, the wire 124 extends directly over the medication containers 108 stored in the interior storage space 102. Thus, the wire 124 additionally maintains the medication containers 108 within the interior space 102 to prevent damage during transportation and storage.

The cartridge 90 can preferably be made from a rigid metal such as aluminum. The retaining member 110 can preferably be made of a semi-rigid thin material such as spring steel which is sufficiently rigid to prevent access to the medication containers 108. While the cartridge 90 can be filled by a pharmacist at the hospital or other medical facility, the cartridge 90 is preferably filled in an automated process at a centralized location for distribution pre-filled to users.

Figure 15:
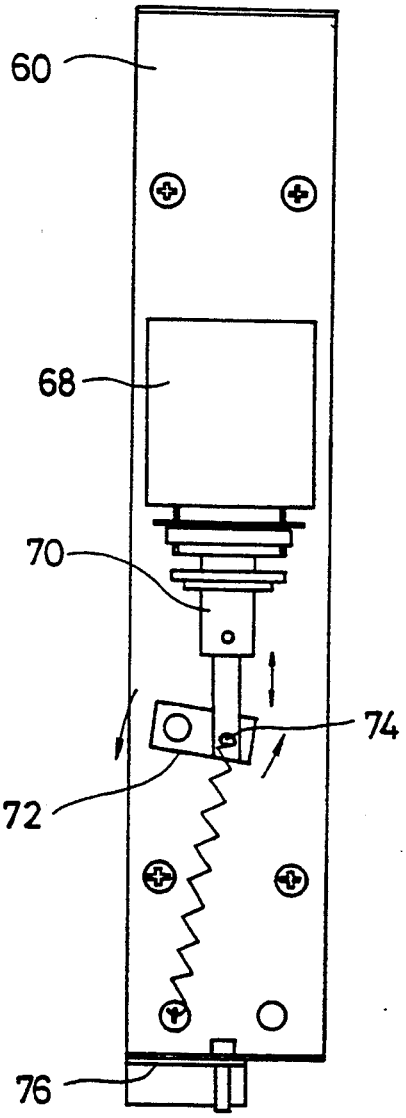
FIG. 15, FIG. 16 and FIG. 17 are a side view, a plane view and a cut-away view of the dispenser making one body together with the cartridge, respectively.

Referring now to FIG. 10, an elevational cross sectional view similar to that seen in FIG. 4 in which a cartridge 90 has been inserted into a dispenser 60 is seen. Upon insertion of the cartridge 90, the user grasps the flange 118 and pulls the retaining member 110 to allow free fall of the medication containers 108 to the dispensing platform 86. Upon actuation of the solenoid 68 and resultant pivot of the pivot rod 74, the stepped actuator arm 82 rotates counter-clockwise with the stepped portion 84 contacting the medication container 108 resting on the dispensing platform 86 and urging the medication container 108 towards the aperture 88. Concretely, those movements are shown by arrows in FIGS. 15 and 17. When the medication container 108 is urged to a position over the aperture 88, gravity induces it to fall, which passage is sensed by the juxtaposed sensor 66 and relayed to the microprocessing means 26.

When the medication container 108 is urged from the dispensing platform 86, gravity pulls the remaining medication containers 108 toward the dispensing platform 86. While the stepped actuator arm 82 is maintained by the solenoid 86 in a counter-clockwise position, the remaining medication containers 108 fall against a generally horizontal portion of the stepped portion 84 of the stepped actuator arm 82 which prevents additional medication containers 108 from dispensing. Upon rotation of the stepped actuator arm 82 in a clockwise direction to its original position, the medication containers 108 free fall and rest against the dispensing platform 86 in position for the next dispensing. The dispensed medication container 108 free falls past the respective defined apertures 52, 54 in the printed circuit board 50 into the drawer 28 for access by the user.

Figure 11:
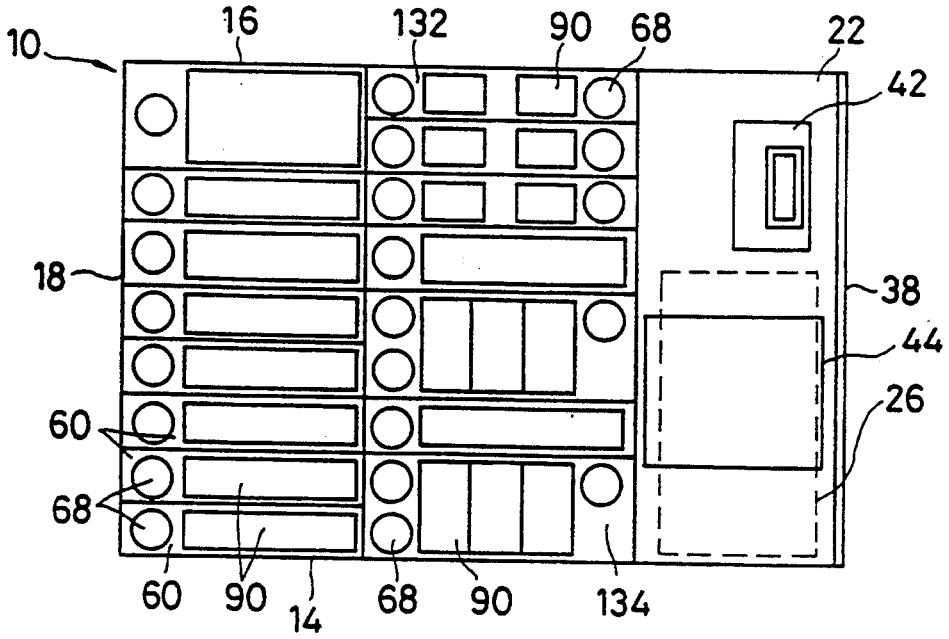
FIG. 11 is a partially cut-away overhead view similar to FIG. 2 showing the cartridge of FIG. 5, 6 and 7 the dispenser of FIGS. 3 and 4 in the apparatus of FIG. 1.

Referring to FIG. 11, an overhead view of device 10 having dispensers 60 and cartridges 90 within the medication storage area is seen. By standardizing the female electrical connectors 56 on the printed circuit board 50 and the male electrical connectors 78 on a variety of different sized dispensers 60 and cartridges 90, a plurality of different sized medication containers 108 can be user selected. For example, a standard small size can be utilized for 2. cc ampules. An enlarged small size can be utilized for larger 10. cc ampules.

Additionally, if smaller medication containers 108 are utilized such as, for example, 2 ml vials, dual dispensers 132 can be utilized having two solenoids 68, two optical sensors 66, two interior spaces 102 defined to receive two cartridges 90, etc., and two male electrical connectors 78 to mate with two cooperating female electrical connectors 56. Finally, if cup-form medication dispensers are desired, for oral liquid medications, for example, a tri-dispenser 134 can be utilized having three solenoids 68, three optical sensors 66, three interior spaces 102 defined to receive three cartridges 90, etc., and three male electrical connectors 78 to mate with three female electrical connectors 56.

Thus, the user can select any desired combination to dispense a vast variety of different type medication container 108 and thus medications. Once the desired combination is determined, a pharmacist or mechanic can input which female electrical connector 56 is dedicated to control the dispensing along with additional inventory information into the microprocessing means 26.

Figure 19:
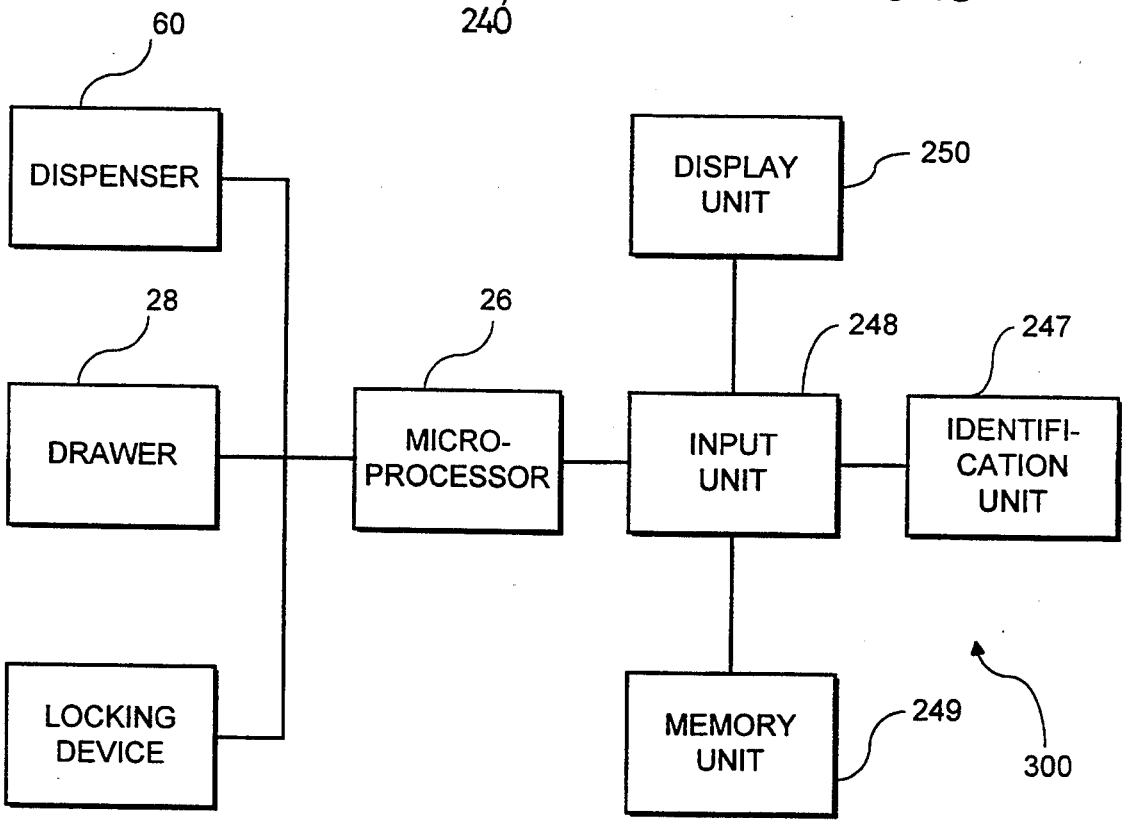
FIG. 19 is a block diagram of a control unit.

Next we will describe the control unit 300. As indicated in FIG. 19, the control unit 300 is composed of the identification unit 247, which uses passwords, IC cards or similar means to allow individual identification of users; the input unit 248, which is used to input the type and number of medications to be dispensed from the device 10; the memory unit 249, which records data input to the input unit 248; the display unit 250 which displays data input to the input unit 248, data recorded in the memory unit 249, and feedback information from the device 10; and the microprocessing means 26, which uses information designated in the input unit 248 to provide drive control for the automatic dispensing of the desired type and number of medications from the device 10, as well as control operation of the drawer 28 and the locks. For example, while the use of a card reader employing an IC card or magnetic card has been described in the identification section 247, it should be clear that other kinds of identification methods, including passwords, fingerprints, voice identification, hand prints (three-dimensional), signs and other such methods can also be used, in any case so as to make it impossible for unauthorized personnel to operate the automatic dispenser for injectable medications.

Also, which the identification section 247, input section 248 and display section 250 can make use of a commercially available personal computer or other like device, other devices specially designed for the purpose may also be incorporated into the device 10.

Figure 12:
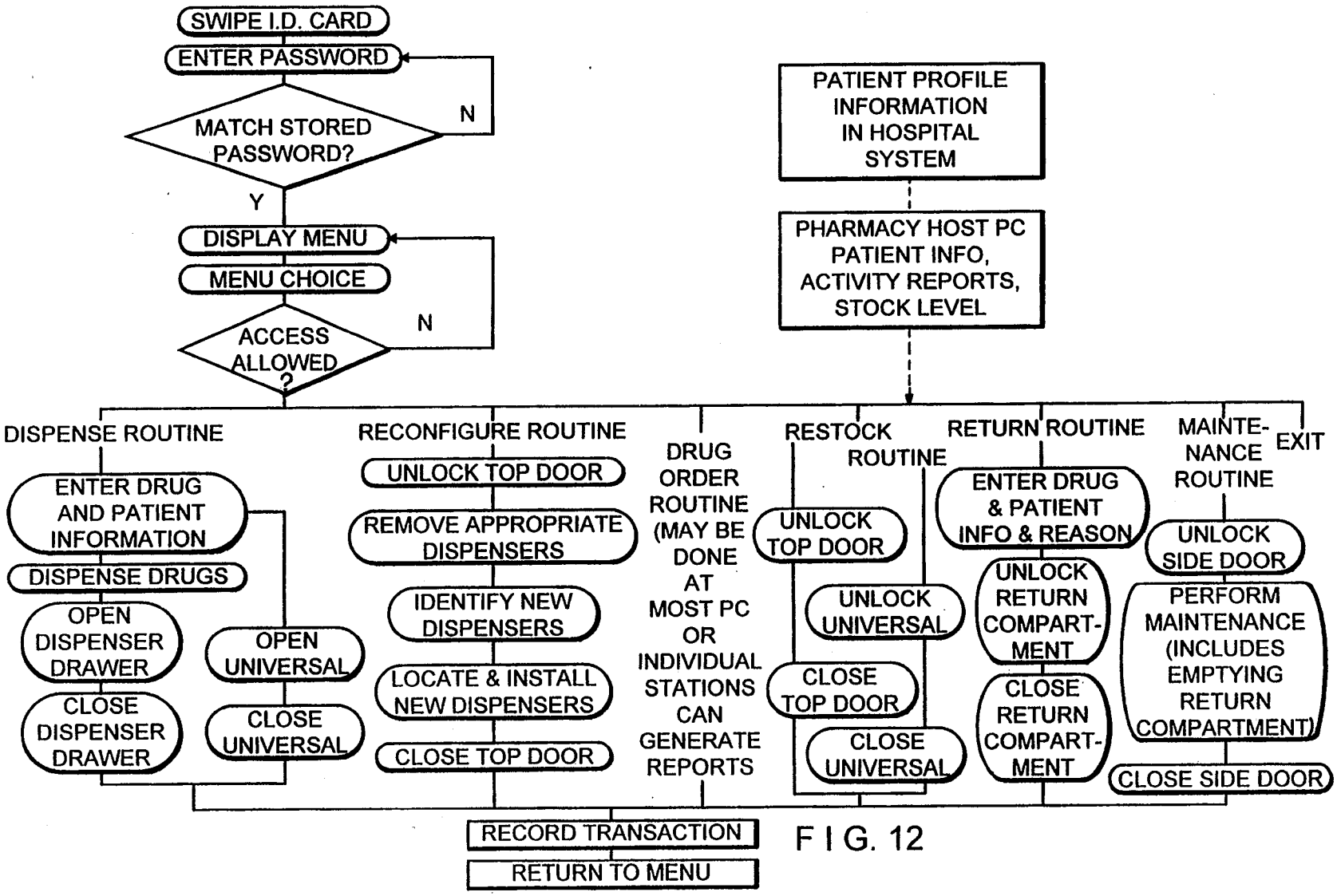
FIG. 12 is a flow diagram showing the preferred method of dispensing in accordance with the principles of the present invention.

Referring now to FIG. 12, a preferred embodiment of the method of operation is depicted. The present system is designed for either stand alone use or networked with a host computing means in a central location such as a pharmacy. In the event the unit is networked, data such as patient profiles, stock levels, and the like can provided by the host computing means to the units.

To operate the device, initially the user inserts a magnetic identification card which is read or "swiped" by the card reader. The user interface screen then asks for the user's personal identification number (PIN). If the user inserted personal identification number (PIN) matches the card read, access is allowed and a menu is displayed.

In the presently preferred embodiment, seven routines, including Dispense, Reconfigure, Restock, Return, Order, Maintenance and Exit are provided. The microprocessing means will allow access to the different routines in accordance with preprogrammed user level of access. For example, a nurse may be preprogrammed to have access to the Dispense, Order, Return and Exit routines, but not the Reconfiguration or Restock routines, A pharmacist may have access to the Restock, Reorder, and Exit routines, but not the Dispense, Reconfigure or Return routines. A service person such as a hospital biomedical engineer may have access to the Reconfigure, Maintenance and Exit routines, but not the Dispense, Order, Restock or Return routines. Access can be preprogrammed in accordance with hospital policy.

If the properly identified user desires access to the Dispense routine, the user selects from the menu on the touch screen the Dispense routine. The user interface screen then asks for and the user identifies inventory control information such as the type of drug, patient information, and any other inventory controls. Additional data such as time from a clock means in the microprocessing means can also be added.

After the inventory controls are inputted, the microprocessing means activates the appropriate solenoid via the female electrical connector to dispense the selected drug. Alternatively, if the selected drug is contained in the universal compartment, the locking latch mechanism is released to allow user access.

After the appropriate solenoid has been activated and the medication container has fallen into the dispensing drawer, the locking latch mechanism which closes the dispensing drawer is released which allows the dispensing drawer to be opened. The user can then withdraw the dispensed medication container.

Following withdrawal of the dispense medication container, the user manually closes the dispensing drawer. The locking latch mechanism secures the drawer and communicates to the microprocessing means that the drawer has been closed. Alternatively, if the universal compartment has been utilized, the user closes the universal compartment door with that locking latch member indicating to the microprocessing means that the door has been closed.

The transaction is then recorded in random access memory (RAM) in the microprocessing means for inventory control purposes. In an alternative preferred embodiment, the microprocessing means can be interfaced with a dedicated printer to provide a physical printout of the transaction in addition to the electronic storage. After recording of the transaction, the microprocessing means returns the user interface screen to the selection menu where the user can continue to execute an additional routine or select the Exit routine.

If the user selects the Reconfigure routine, the microprocessing means determines whether the user is authorized to continue on that routine. If the user is authorized, the microprocessing means will unlatch the locking latch mechanism on the top door which allows the user to open the door and gain access to the medication storage area. The user then inputs the new dispenser location into the microprocessing means via the touch screen. After inputting the identification of the new dispenser, the user then physically reconfigures the new dispensers. After the new dispensers have been configured, the user then inputs the type of medication to be dispensed at each location. The user then closes the top door and the locking latch mechanism communicates to the microprocessing means to record the reconfigured transaction. The microprocessing means then returns the touch screen to the original menu where an additional routine can be selected.

If the user selects the Restock routine, the microprocessing means first determines whether the user has access to that routine. If the user does have access to that routine, the locking latch mechanism on the top door is unlatched while the locking latch mechanism on the universal storage compartment on the door is simultaneously-unlatched. The user then gains access to the drug storage or the universal storage compartment and inserts a full drug cartridge into the appropriate dispensers or adds the dedicated medication to the universal storage compartment. After the universal storage compartment door and the top door have been closed, the transaction is recorded and the microprocessing means returns the interface screen to the original menu.

If the user selects the Return routine, the user interface screen requests appropriate inventory control information such as, for example, the medication, the patient, and the reason for return. Once again, additional information such as time can be inputted. After the inventory control information has been input into the microprocessing means, the microprocessing means unlatches the locking latch mechanism on the return compartment, therefore allowing the user access. After the user has returned the drug into the return compartment, the closing of the return door signals to the microprocessing means that the return is complete. The transaction is then recorded and the screen is returned to the original menu.

If the user selects the maintenance routine, the side door is unlocked. This allows access to the return compartment as well as servicing. After maintenance is completed, the user closes the side door and the screen is returned to the original menu.

A drug order routine can also be provided. The drug order routine can automatically track the inventory of drugs. In the event of a stand alone unit, the individual station can generate a report of the use at a dedicated printer. In the event that the units are networked to a host computing means in a central location, such as a pharmacy, a report can be generated at that location. In an alternative embodiment, the system can be designed to automatically signal when a drug quantity reaches a predetermined low level. Of course, if the Exit routine is selected, the microprocessing means and user interface screen return to the original display.

It should be understood that various changes and modifications to the preferred embodiments described herein will be apparent to those skilled in the art. Such changes and modifications can be made without departing from the spirit and scope of the present invention and without diminishing its attendant advantages. It is, therefore, intended that such changes and modifications be covered by the appended claims.

We claim:

1. A drug dispensing apparatus comprising:

microprocessing means;

a housing defining an interior medication storage area, the interior medication storage area including means for receiving a plurality of different sized dispensers in multiple orientations, the receiving means further including means for establishing electrical communication between the dispensers and the microprocessing means; and a receiving drawer oriented below the interior medication storage area to receive medication vertically falling from the dispensers, and to dispense the medication through an open position of said receiving drawer, said receiving drawer having a width substantially equal to a width of said plurality of dispensers and having a depth less than a depth of said plurality of dispensers.

2. The apparatus of claim 1 wherein the receiving means includes a plurality of spaced electrical connectors in electrical communication with the microprocessing means, the electrical connectors being adapted to establish electrical communication with cooperating electrical connectors on the dispensers.

3. A drug dispensing apparatus comprising:

microprocessing means;

a housing defining an interior medication storage area, the interior medication storage area including means for receiving a plurality of different sized dispensers in multiple orientations, the receiving means further including means for establishing electrical communication between the dispensers and the microprocessing means;

a receiving drawer oriented below the interior medication storage area to receive and dispense medication from the dispensers;

wherein the receiving means includes a plurality of spaced electrical connectors in electrical communication with the microprocessing means, the electrical connectors being adapted to establish electrical communication with cooperating electrical connectors on the dispensers; and wherein the electrical connectors are contained on a generally horizontally oriented printed circuit board, the circuit board defining at least one aperture through which dispensed medications fall.

4. The apparatus of claim 1 further including a touch panel or a keyboard in electrical communication with the microprocessing means.

5. The apparatus of claim 1 further including user identification means.

6. The apparatus of claim 5 wherein the identification means is a card reader.

7. The apparatus of claim 1 further including a storage compartment for drugs, said storage compartment being substantially larger than said dispensers, whereby drugs which do not fit into said dispensers may be stored in said storage compartment.

8. The apparatus of claim 1 further including a return drug storage compartment whereby a user can return a drug to said return drug storage compartment, said return drug storage compartment being separate from said plurality of dispensers.

9. An apparatus for dispensing a plurality of sized medication containers, the apparatus comprising:

microprocessing means;

a housing defining an interior medication storage area, the interior medication storage area adapted to receive a plurality of different sized dispensers, the interior medication storage area further including a plurality of spaced electrical connectors in electrical communication with the microprocessing means and adapted to be cooperatively connected to cooperative electrical connectors contained on the dispensers such that the microprocessing means can electrically communicate with each selected dispenser; and a receiving drawer positioned beneath the interior medication storage area such that dispensed medication containers can fall by gravity into the drawer for dispensing, said receiver drawer having a width substantially equal to a width of said plurality of dispensers and having a depth less than a depth of said plurality of dispensers.

10. A cartridge containing medication containers for use in a drug dispensing apparatus having a removable dispenser, the dispenser having a gravity fed dispensing platform and an actuator arm for urging the medication containers off the dispensing platform, the cartridge comprising:

a container having a front, a back, two sides, a top, an open bottom, and defining an interior, the container being sized to accept the medication containers in the interior;

the front of the container having an opening extending upwardly from the open bottom, the front opening being sized to accept a retaining member having a portion extending into the interior of the container to retain the medication containers within the container; and the retaining member further being removably secured to the outside of the container and including a portion extending upwardly from the inwardly extending portion such that the retaining member can be removed from the container by pulling the upwardly extending portion.

11. The cartridge of claim 10 wherein the retaining member is generally T-shaped with the inwardly extending portion being an enlarged width area.

12. The cartridge of claim 10 wherein the container and the retaining member define a plurality of apertures through which a wire extends to secure the retaining member to the container.

13. The cartridge of claim 10 wherein the container is made of metal.

14. The cartridge of claim 10 wherein the container is made of plastic.

15. The cartridge of claim 10 wherein the retaining member is made of spring steel 16. A dispenser for use with a drug dispensing device, the drug dispensing device having a plurality of standardly spaced electrical connectors in electrical communication with a microprocessing means, the dispenser comprising:

a housing defining an interior chamber for receiving a cartridge having medication containers therein and further defining a sliding drawer to receive the medication containers and, from an open position, to dispense the medication containers to a user, said sliding drawer having a width substantially equal to a width of said plurality of dispensers and having a depth less than a depth of said plurality of dispensers;

the housing further defining a dispensing platform juxtaposed relative to the interior chamber, the dispensing platform defining an aperture offset from the interior chamber;

an electronically activated actuator contained in cooperative relationship to the dispensing platform such that medication containers resting on the dispensing platform can be urged to the defined aperture in route to said sliding drawer; and an electrical connector in electronic communication with the actuator and the microprocessing means and adapted to cooperatively secure the electrical connectors in the dispensing device.

17. The dispenser of claim 16 wherein the actuator includes a solenoid or a motor.

18. The dispenser of claim 17 wherein the actuator further includes an actuator arm controlled by the solenoid or a motor.

19. The dispenser of claim 16 further including an optical reader in electronic communication with the electrical connector in electronic communication with the actuator and positioned over the dispensing platform defined aperture.

20. A drug dispensing apparatus comprising, a housing formed from a box structure with an upper opening and a lid which can be opened and closed over the opening; a plurality of dispensers arranged in order inside the housing; multiple cartridges being accepted in the dispensers and holding disposable injectors, ampules and other injectable medications; a control unit provided with a microprocessing means for controlling the dispensers and the housing, comprised of an identification section utilizing passwords or integrated circuit cards to allow identification of users, an input unit for inputting the type and number of medications to dispensed from the housing, a memory unit for recording data from the input unit, and a dispensing section for automatically dispensing the requested type and number of medications from the housing based on the information designated by the input unit, said dispensing section including a sliding drawer to receive the medications and, from an open position, to dispense the medications to a user said sliding drawer having a width substantially equal to a width of said plurality of dispensers and having a depth less than a depth of said plurality of dispensers.

* * * * *